US007673551B2

(12) United States Patent
Meurer

(10) Patent No.: US 7,673,551 B2
(45) Date of Patent: Mar. 9, 2010

(54) AERIAL-SUPPORTED PROCEDURE FOR THE DETECTION OF LANDMINES

(76) Inventor: Heinrich Meurer, Lessingstr. 30, D-50321 Bruehl (DE)

( * ) Notice: Subject to any disclaimer, the term of this patent is extended or adjusted under 35 U.S.C. 154(b) by 195 days.

(21) Appl. No.: 11/839,215

(22) Filed: Aug. 15, 2007

(65) Prior Publication Data

US 2009/0044691 A1 Feb. 19, 2009

(51) Int. Cl.
*B64D 1/00* (2006.01)

(52) U.S. Cl. ..... 89/1.13; 434/4; 435/29; 86/50

(58) Field of Classification Search ..... 89/1.13; 102/301, 302, 366–377; 86/50; 273/410; 434/4; 435/29
See application file for complete search history.

(56) References Cited

U.S. PATENT DOCUMENTS

| | | | | |
|---|---|---|---|---|
| 5,972,638 | A * | 10/1999 | Burlage et al. | 435/29 |
| 6,055,214 | A * | 4/2000 | Wilk | 89/1.13 |
| 6,521,446 | B2 | 2/2003 | Hellinga | |
| 6,626,078 | B2 * | 9/2003 | Thornton | 89/1.13 |
| 6,711,475 | B2 * | 3/2004 | Murphy | 701/3 |
| 2003/0036827 | A1 * | 2/2003 | Murphy | 701/3 |
| 2005/0262995 | A1 * | 12/2005 | Kilkis | 89/1.13 |

FOREIGN PATENT DOCUMENTS

| | | |
|---|---|---|
| DE | 4126692 | 2/1993 |
| GB | 2330801 | 5/1999 |
| WO | 97/03201 | 1/1997 |
| WO | 99/34212 | 7/1999 |
| WO | 02/068473 | 9/2002 |

OTHER PUBLICATIONS

Laserscanner ALTM 3100 of the firm Optech, Canada, Copyright 2004, Optech Incorporation.
Litemapper 2800 of the IGI mbH, Germany; Oct./Nov. 2006; GEOinformatics.
http://www.arc.vub.ac.be/html/overview.htm.

* cited by examiner

*Primary Examiner*—Michael Carone
*Assistant Examiner*—Jonathan C Weber
(74) *Attorney, Agent, or Firm*—Marianne Fuierer; Moore & Van Allen, PLLC

(57) ABSTRACT

The present invention refers to an aerial-supported procedure for the detection of landmines, duds or similar explosive bodies using a fluorescence procedure, including aerial-supported geo-referencing of the detected locations by means of a digital terrain model.

15 Claims, No Drawings

AERIAL-SUPPORTED PROCEDURE FOR THE DETECTION OF LANDMINES

BACKGROUND OF THE INVENTION

1. Field of the Invention

The present invention refers to an aerial-supported procedure for the detection of landmines, duds or similar explosive bodies using a fluorescence procedure, including aerial-supported geo-referencing of the detected locations by means of a digital terrain model.

2. Description of Related Art

Areas strewn with landmines represent a considerable danger for the civilian population. This correspondingly applies also for areas where there are so-called duds, i.e. shells, bombs and other explosive bodies that have not been made to detonate. In addition, the latter represent a considerable danger because the ignition mechanism can be triggered off through external actions as driving or walking over the respective area. Whenever the term "mines" is used hereafter, it includes all explosive bodies existing in an area.

Areas strewn with mines constitute a considerable risk for the civilian population even decades after the ending of hostilities or after their laying. Thus for example, minefields that were laid during the Second World War are not usable up to the present day in parts of Europe and Africa. The same applies for areas suspected of containing mines where it is not clear whether there were mines laid there or not, and which are correspondingly made inaccessible for security reasons. In addition to the direct danger to people, there are also considerable economic disadvantages caused by the non-usability of the affected areas, especially for agriculture or transport.

A well-known procedure for clearing minefield is the use of sniffer dogs which trace olfactively mines laid in the earth. The locations of the mines indicated by the sniffer dog are then checked by a diffusing expert and the mine, if present, diffused. However, considerable disadvantages are evident with this procedure. The reliability of the indication by the sniffer dogs is very limited and is subject to a high error rate. Especially problematic here is that a considerable number of mines are not indicated by the sniffer dogs. Thus it is normal that an area to be cleared is gone over at least three times by different sniffer dogs. This type of negative error, i.e. a non-indication of mine location, is extremely dangerous for both the dog and dog-handler since the non-indicated mine can be inadvertently stepped on and triggered off. Moreover, the effective time of use for mine sniffer dogs is limited to a few hours per day. Beyond this time, the efficiency of the sniffer dogs lessens to a degree that is not defensible.

Further established methods are the bit-by-bit digging by hand of the terrain, the scanning of the area being examined with metal detectors or the mechanical setting-off of mines by means of rollers or by devices that plough up the earth. All these devices have, however, their specific disadvantages. Metal detectors are not designed to deal with plastic mines, which are especially used as mines targeting people, and so bring the user into danger. Rollers or devices that plough up the earth are usable only restrictively dependent on the suitability of the terrain. Moreover, the danger exists that mines, especially those targeting vehicles, which are constructed for to be driven over several times before exploding are thereby not triggered off and thus made harmless.

The publication GB 2 330 801 describes an aerial-supported system for the clearance of mines whereby the area to be cleared is illuminated by a laser. A sensor registers a different reflection behaviour of the landmine or the soil above the landmine in contrast to the surroundings. The so-detected location of the mine can be marked via a colour cannon or the mine can be made to explode from the air.

U.S. Pat. No. 5,972,638 describes a procedure for detecting buried or submerged explosive bodies by means of a biosensor. By biosensors are here meant micro-organisms that, due to manipulation, especially by genetic engineering, are enabled to become luminescent, especially fluorescent, in the presence of explosives. The document describes especially the use of recombinant bacterial strains of the bacillus groups, pseudomonas, as well as *Escherichia Coli* as biosensors and also procedures for the genetic engineering of these. The biosensors named exhibit luminescence, respectively fluorescence behaviour in the presence of explosives, especially trinitrotoluol, hexahydro-1,3,5-trinitro-1,3,5-triazine as well as octahydro-1,3,5-trinitro-1,3,5,7-tetrazocine. Further, other biosensors for determining explosives are also known from the publications DE 41 26 692, WO 02/068473, WO 97/03201. The publication WO 99/34212 describes also the manufacturing process and the use of fluorescent biosensors that are suitable for detecting explosives.

In order to carry out the procedure for detecting buried explosive bodies, a solution containing the biosensor is sprayed over the area under examination, preferably from an aeroplane, followed by a sufficient time for the micro-organisms to become effective in the area under examination.

The detection is effected by means of a CCD camera during twilight. Hereby, the vicinity of the camera is alternately radiated with UV light. The camera system takes shots under UV radiation and also without using it, by which, depending on the corresponding image processing, the respective positions of the explosive bodies become recognisable by the UV fluorescence.

The fluorescent lamps and the camera system can be carried by the user. Alternatively, the installation on a robot is possible. The system has the disadvantage that the minefield or the suspected area has to be walked on or driven over and only small areas can be checked in one working step due to the limited range. Moreover, the daily work slot is confined to a few hours at twilight, both at the start and the end of the day.

Furthermore, there is the added problem that many of the areas strewn with mines are in countries with low economic power, especially in Africa and South-East Asia. These countries can raise only small amounts of financial resources, or none at all, for the clearing of minefields. Therefore there is an urgent need to provide an efficient, safe and cost-effective procedure for the detection and clearance of minefields and the like.

SUMMARY OF THE INVENTION

The present invention overcomes the disadvantages of the prior art and provides a method for detecting landmines and other explosives, especially buried landmines and explosive bodies, wherein the method comprises using biosensors in combination with aerial-supported detection thereby allowing for the inspection of a mine-suspected area with high speed and accuracy.

In one aspect, the present invention provide for a method for detecting landmines and other explosives in a testing area to be examined, the method comprising:

a. aerial spreading of biosensors on the surface of the testing area to be examined, wherein the biosensors have the ability to metabolize explosives and provide an indicator signal of such metabolism;

b. waiting a sufficient amount of time for interaction of the biosensors with the explosives for the metabolism of the explosives;

c. exposing the biosensors and surface of the testing area to an aerial-supported source of electromagnetic energy having at least one wavelength sufficient to stimulate the indicator signal of the biosensors;

d. detecting simultaneously the indicator signal of the biosensors and the surface reflection signal of the electromagnetic energy to provide data for a digital terrain model showing topographic detail of the surface testing area and locations or concentrations of explosives.

A further sub-task of the present invention is to provide a procedure that performs the cartography of the locations of the explosive bodies by means of high-precision geo-referencing.

Various other aspects, features and embodiments of the invention will be more fully apparent from the ensuing disclosure and appended claims.

DETAILED DESCRIPTION OF THE INVENTION

The present invention provides an aerial-supported procedure for the detection of mines and explosive bodies by means of using an aerial-supported laser scanner, in combination with biosensors sensitive to explosives, subject to simultaneous high-precision geo-referencing with reference to a digital terrain model.

The present invention makes use of the well-known biosensors which are sensitive to explosives on the basis of manipulated micro-organisms, hereafter just called biosensors. Appropriate biosensors are described e.g. in U.S. Pat. No. 5,972,638.

As to the methods according to the present invention, aqueous solutions of the cultures of the biosensors are spread out in a suitable process. A well-known possibility for a fast spread-out on a large surface makes use of sprayer airplanes which spread aerosol or mist of the aqueous solutions of the culture on the area which has to be examined.

This spreading of the micro-organism is followed by a reaction time during which the micro-organisms, serving as biosensors, interact with the explosives to be detected. A well-known fact is made use of here in that mines or other explosive bodies give off tiny amounts of explosives into their close surroundings. After a sufficient interaction time of the biosensors with the explosives, the micro-organisms are activated and explosives bodies are ready for detection.

In accordance with the present invention, the detection is carried out by means of an aerial-supported laser scanner, using a modified laser for stimulating fluorescent radiation with biosensors on the ground, in combination with the aerial-supported detection and geo-referencing of the fluorescent radiation on the ground. This is effected via an image-creating procedure of the laser scanner as well as optionally by depicting true-to-detail minefield mappings, in order to provide secure orientation and localising of landmines by mine-clearing devices (or personnel) on the ground.

Hereby, an aerial-supported laser scanner is used to perform a continual altitude measurement of the overflown area being measured. In a manner that is principally known, the laser scanner determines the respective altitudes by means of propagation time measurements of its laser pulses that are reflected from the ground. This signal is referred to hereafter as surface reflection signal. Simultaneously, each of the individual altitude measurements is assigned with a precise geographical position of the aeroplane. The geographical position can be determined via DGPS (Differential Global Positioning System), especially in combination with a high-precision inertial navigation. From the altitude data correlated with the respective positions, a digital terrain model of high resolution is produced which precisely images the surface of the flown-over area.

From the resulting elevation data, in combination with the corresponding position data, a digital terrain model of high resolution is generated which gives a precise image of the surface of the flown-over area.

In a special embodiment it is possible to distinguish between the first and the last reflection on the ground of a multi-reflecting laser pulse between the ground surface on one hand and the upstanding vegetation or other artefact objects on the ground on the other hand. Hereafter the representation of the immediate ground surface is defined as digital ground model and the representation of the surface with vegetation and/or artefact objects is defined as digital surface model. In this embodiment of the invention it is possible to represent the ground profile, e.g. in wooded regions, without the representation of the disturbing vegetation.

In another embodiment, the above-mentioned aerial-supported laser scanner is combined with a digital line camera. The resulting visual image of the flown over area is then combined or superposed with the digital ground model and/or the digital surface model. The application advantages are further explained below.

For transforming the digital altimetry model into the digital ground model and/or digital surface model, the measured data is assigned to a screen. The measured data consist of altimetry data which is related to the geographic data, as explained before. The screen line width of the resulting screen is an essential characteristic of the present invention. An appropriate screen line width, i.e. the horizontal resolution of the model should not be less than 0.25 meter. A larger raster width results in considerable uncertainties in subsequently finding real mines in the area being cleared.

On the other hand, a resolution of 0.25 meters or smaller is sufficient. Such a horizontal resolution of 0.25 meters can be attained in the terrain only under favourable conditions by mine-dogs or by guiding oscillatingly magnetic probes for to detect metallic landmines.

Appropriate laser scanners to reach a horizontal resolution of 0.25 meter or less are available in the market. The laser scanner ALTM 3100® of the firm Optech, Canada and Litemapper 2800® of the firm IGI mbH, Germany are given as examples.

Besides the appropriate laser scanner, also the flight altitude and the flight speed of the laser scanner over the ground have an impact on the horizontal resolution. Thus, when requiring resolution of 0.25 meter or less, the resolution can be improved by reducing flight speed and/or flight altitude.

Notably, the laser can be adjusted to provide an emission wave length to the stimulation wave length of the biosensors. This measure stimulates the biosensors to transmit a detectable fluorescent radiation if they have been activated by the contact with explosives. This detectable fluorescent radiation hereafter is also called fluorescent signal. This so-called secondary radiation is emitted in a wave length which is defined in accordance with the biosensors. Hereby, the wavelength of the secondary radiation is not equal to the stimulation wavelength. Depending on the biosensors and thus depending on the chosen fluorophore, the secondary radiation has generally a 30 to 60 nm longer wavelength than the stimulation radiation. This has the advantage that for a laser pulse with a defined wavelength which corresponds with the stimulation radiation of the biosensor, two signals of different wavelengths will be received. The first signal (the surface reflection signal), has the same wavelength as the stimulation wavelength and, in the way as described before, serves for geo-referencing of the measuring point. The second signal (fluorescent signal) has a longer wavelength and shows the presence of activated biosensors and thus indirectly indicates the presence of explosive traces at the measuring point. As a consequence hereof only one stimulation signal of one wavelength is needed. The use of a second laser with another wavelength for the detection of the surface signal is not required and can be dropped.

In another embodiment, laser pulses of different wavelengths can be used. Laser pulses of different wavelengths in the sense of the present invention are at least two laser pulses which are transmitted simultaneously or nearly simultaneously to a measuring point where one of the laser pulses has the stimulation wavelength of the biosensor and the other laser pulse incorporates a wavelength which differs from the first one and where the latter laser pulse continues serving to generate the surface reflection. In this embodiment the wavelength of the biosensor signal and of the surface reflection signal are more distant from each other. A bigger distance of the wavelengths of the signals to be detected facilitates the discrimination and therefore the detection.

In a further sub-embodiment of the embodiment described hereinabove, several laser pulses can be employed with different wavelengths for the stimulation of the biosensors. The latter measure is useful, if at least two different biosensors are employed simultaneously that have different stimulation wavelengths.

If according to this sub-embodiment two biosensors with different stimulation wavelengths are being employed, three laser pulses with different wavelengths would be useful. Two of the laser pulses hereby serve to generate the fluorescent signal and the third one to generate the surface reflection signal. Whenever more than two biosensors with different stimulation wavelengths are employed at the same time, this practice should be used accordingly.

The simultaneous employment of different biosensors and therefore of different stimulation wavelengths can serve to detect different landmines, respectively explosive bodies, which contain different explosive materials, as far as the biosensors are selective for the respective explosive materials.

According to the invention, the laser scanner is equipped with a detection unit which is able to detect and discriminate signals with different wavelengths. The detection unit has an appropriate wavelength-discriminating suppression filter which is able to perform the measurements in both the wavelength ranges, as described before, within sufficiently short time intervals. In another embodiment the detection unit has two separate detectors which individually detect the respective, specific wavelength of the described signals.

In a further embodiment the laser scanner is provided with a separate laser stimulation for the biosensors, as well as with a separate detection device for the emission wavelength of the biosensors, which are both integrated on the platform of the laser scanner and thus are equally geo-referenced by the precision of the laser scanner.

The above-mentioned advantages are obvious. After injection of the area to be examined with the biosensors, both a geo-referencing can be performed and the locations of the landmines, respectively explosive bodies in this area can be identified immediately in a single measuring step, i.e. flying over the area. A further essential advantage consists in the fact, that inexactitude of measurement is eliminated with regard to the geographic position. The detected fluorescent signal is directly correlated with the geo-referenced surface reflection signal, so that the location of the mines in the digital ground model and/or the digital surface model is clearly defined.

Further advantages of the procedure and system, in line with the invention, result from the further steps in the mine-clearance process.

Hereafter, the obtained, digital ground model and/or digital surface model with the locations of the detected landmines, which are indicated herein, will be transferred to a portable data visualizing device, e.g. laptop. Hereby optionally, the visual image of the area, which was optionally obtained, can be combined and/or superposed with the ground model and/or with the surface model.

The actual mine clearance is now carried out in the traditional way by a mine-searcher/mine diffuser. In doing so, the mine-searcher moves safely over the area by means of the ground model and/or surface model represented on the portable data display unit, especially in combination with the optional visual representation. The respective mine locations can be gathered from the representation.

In another embodiment, the acquired data can be printed out as map material.

The purely digital model already reproduces the surface of the minefield in full detail and thus enables a sure orientation independent of coordinate specifications. Through a visual matching of the digital ground model with the reality of the minefield, concise structures are surely recognisable again and are to be set in relation to the mine locations. These include e.g. roads, dirt roads and paths, terraces, terrain edges, terrain hollows and elevations, cultivated or uncultivated arable land, ditches, stream and river courses, water surfaces, individual rocks, as well as trenches and explosive craters. The latter also insofar as these should be overgrown by vegetation.

In addition to the ground model, the digital surface model identifies in detail the upstanding vegetation, as well as all the artificial objects. Amongst the vegetation, well recognizable reference objects are included, such as trees, hedges, as well as edges of forests. Amongst the artificial objects, i.e. artefact objects especially fences, individual pales, wall enclosures, houses, sheds, wells, all kind of masts, as well as wrecks of tanks or similar semi-permanent objects facilitate the orientation in the area additionally.

In a further optional embodiment, the mine-searcher can determine simultaneously his geographical position with a portable DGPS navigation system and use this to optimally find his way safely through the area laid with mines. Especially the use of a portable visual display unit with its own corresponding computing capacity enables the representation to be automatically so selected via a direct coupling of the DGPS receiver that the represented map section shows the direct proximity field of the current location of the mine-searcher. For this, the geographical data acquired by the laser scanner is used and is correlated via the portable DGPS with the actual specifications, i.e. geographical data of the mine-searcher, that are indicated by the portable DGPS. Of course, an automatic alignment of the DGPS and the representation unit is also possible. The necessary technology for this has been known for long from the navigation system for passenger cars using GPS navigation as an aid.

The deviations associated with a portable DGPS between the exact, real location and the location indicated by the DGPS can be directly corrected by the mine-searcher via a simple and direct alignment of the ground model/surface model as well as, if need be, of the represented visual picture of the surroundings.

The digital models of the minefields are therefore to a large degree confidence-building for the mine-searcher and enable him to have a close-up view of the mine positions to work with.

In the cases where mines are not to be transported away but diffused through being exploded already on the terrain, it is to be expected that the ignition of impact charges on the ground surface over the precisely proven mine positions is sufficient for a sure clearance. The time-consuming and dangerous visual verification of the mines can then be omitted.

The present invention therefore provides a procedure that allows a safe and cost-effective detection of mines and clearance of minefields. Likewise, the procedure is suited for reducing the so-called mine-suspected areas.

That which is claimed is:

1. A method for detecting explosive materials, in a testing area to be examined, the method comprising:

a) aerial spreading of biosensors on the surface of the testing area to be examined, wherein the biosensors have the ability to metabolize explosive materials and provide an indicator signal of such metabolism;

b) waiting a sufficient amount of time for interaction of the biosensors with the explosive materials for the metabolism of the explosive materials and activation of the biosensors;

c) laser scanning the biosensors and surface of the testing area by an aerial-supported source of at least one laser, thereby using a laser irradiating with at least a first defined wavelength corresponding to the stimulation radiation of the biosensors to stimulate the biosensors;

d) detecting simultaneously at the measuring point a first signal corresponding to the surface reflection signal of the laser, having the same wavelength as the stimulation wavelength and serving for geo-referencing of the measuring point and a second fluorescent signal, having a longer wavelength and showing presence of activated biosensors at the measuring point, to provide data for a digital terrain model showing topographic detail of the surface testing area and locations of the explosive materials.

2. The method of claim 1, further comprising:

plotting of the data of the surface reflection signal with superposition of the fluorescence signal to provide a data visualization.

3. The method of claim 1, further comprising scanning the surface of the testing area with a camera or digital imaging system to provide a visualised image of the terrain.

4. The method of claim 3, wherein the visualized image is superposed into the digital terrain model.

5. The method of claim 1, wherein the biosensors are retained in an aqueous solution and spread in an aerosol or mist on the surface of the testing area.

6. The method of claim 5, wherein the biosensors retained in an aqueous solution is spread on the surface of the testing area by an airplane.

7. The method of claim 1, wherein the aerial-supported source of laser energy is maintained at a consistent altitude above the surface of the testing area.

8. The method of claim 1, where in the flight speed and/or flight altitude is sufficient to provide horizontal resolution of about 0.25 meter.

9. The method of claim 1, wherein the laser energy is delivered in a continuous or pulse mode.

10. The method of claim 1, wherein at least two lasers are used and each delivers a different wavelength of energy to a measuring point.

11. The method of claim 10, wherein at least two different types of biosensors having different stimulating wavelengths are used and the at least two lasers are employed simultaneously to provide different stimulation wavelengths.

12. The method of claim 11, wherein the at least two different types of biosensors detect different explosive materials.

13. The method of claim 1, wherein an aerial-supported laser scanner emitting laser pulses at a specific wavelength is used in order to make a continuous altimetry of testing area to be examined.

14. The method of claim 13, wherein the propagation time of the laser pulses which are reflected on the ground are measured thereby providing a digital terrain model providing a data on the surface of the testing area.

15. The method of claim 14, wherein the first and the last reflection at a measured point provides data on the ground surface and any upstanding artefact objects on the ground, thereby providing representation of the ground surface and any vegetation and/or artefact objects rising above the surface.

* * * * *